US007196623B1

(12) United States Patent
Wang

(10) Patent No.: US 7,196,623 B1
(45) Date of Patent: Mar. 27, 2007

(54) REMOTE REMINDING SYSTEM

(76) Inventor: Matthew C. Wang, 544 Second Ave., San Francisco, CA (US) 94118

( * ) Notice: Subject to any disclaimer, the term of this patent is extended or adjusted under 35 U.S.C. 154(b) by 219 days.

(21) Appl. No.: 10/944,173

(22) Filed: Sep. 16, 2004

Related U.S. Application Data

(60) Provisional application No. 60/503,561, filed on Sep. 17, 2003.

(51) Int. Cl.
*G08B 21/00* (2006.01)

(52) U.S. Cl. ..... 340/540; 340/10.2; 340/10.3; 340/505; 340/529; 340/539.22; 340/679

(58) Field of Classification Search ..... 340/527, 340/529, 679, 309.16, 309.7, 539.1, 539.3, 340/686.6, 426.15, 457, 5.71, 5.72, 539.22, 340/505, 10.1–10.3, 540
See application file for complete search history.

(56) References Cited

U.S. PATENT DOCUMENTS 5,552,773 A * 9/1996 Kuhnert ..... 340/539.1
5,565,843 A * 10/1996 Meyvis ..... 340/691.6
5,608,378 A * 3/1997 McLean et al. ..... 340/545.1
6,011,468 A 1/2000 Lee
6,631,408 B1 10/2003 Welter et al.
6,703,919 B2 * 3/2004 Baset ..... 340/5.72
6,970,082 B2 * 11/2005 Reese et al. ..... 340/541
2004/0080403 A1 * 4/2004 Eshel ..... 340/426.15

* cited by examiner

*Primary Examiner*—Thomas Mullen
(74) *Attorney, Agent, or Firm*—John P. Costello

(57) ABSTRACT

The inventive device functions to warn a user of the undesirable condition of an appliance or other equipment. An "undesirable condition" may be an automatic garage door that is left open, a toaster oven or electric heater that is left on, an air conditioner that is left on, a security alarm that is left de-activated, or any other condition which is deemed undesirable and would benefit from a warning device which allows a user to return to the location of the appliance and remedy its undesirable condition. The inventive device is comprised of a base unit system that is in monitoring contact with the appliance of interest through at least one sensor, and a remote receiving unit system which travels in the user's automobile. The base unit communicates status information regarding the appliance to the receiving unit and the receiving unit can determine whether the status of the appliance is undesirable. If the status is undesirable, the device warns the user with an alarm, thereby giving the user an opportunity to return to the appliance's location to remedy the undesirable status.

4 Claims, 2 Drawing Sheets

BASE UNIT DIAGRAM

BASE UNIT DIAGRAM

REMOTE UNIT DIAGRAM

REMOTE REMINDING SYSTEM

CROSS REFERENCE TO RELATED APPLICATIONS

This utility patent application claims the benefit of U.S. Provisional Ser. No. 60/503,561 filed on Sep. 17, 2003.

TECHNICAL FIELD

This invention relates to the field of devices for remotely sensing the condition of equipment or appliances and warning a user of the condition of the appliance.

BACKGROUND

Automatic garage doors, gas or electric stoves and ovens and in-home security alarm systems have become common household appliances in many U.S. homes. It is important that an automatic garage door remains closed, that the stoves and ovens remain turned off, and that the security alarms are activated when the household occupant leaves his/her home, usually by driving.

An automatic garage door remaining open is frequently an invitation to theft. In many instance, garage doors are often left open when the occupant leaves due to carelessness on the occupant's part, or the safety device of the automatic door is interrupted by a wandering pet or for other reasons, which causes the door to reopen, unbeknown to the occupant. A forgotten and unsupervised burning stove or oven could cause fire. A de-activated security alarm system could leave the home unprotected. These are the most common items that home occupants forget to check when they leave their homes.

Similar solutions for the garage door problem have been proposed. U.S. Pat. No. 6,011,468 issued to Lee describes a garage door alarm which uses a pair of ultrasonic receivers at the remote garage door opener. In the garage are located two transmitters, one which emits a short distance signal and a second which emits a long distance signal. The transmitters operate only if the garage door remains open. When the vehicle travels beyond the range of the short distance receiver and in the range of long distance receiver, and the garage door is still open, the alarm will activate. However, if the vehicle travels beyond the range of the long distance receiver and the garage door is still open, the alarm will be silent. This invention falls short of solving a real life problem. What will happen if the ultrasonic signal is blocked by the buildings nearby? Will the device still be operative if nearby households have installed the same device? Will the receivers at the remote opener pick up other ultrasonic signals if that neighborhood has a similar device installed? What should be done if the property has multiple cars and multiple garage doors? Will the system still remind the user if the transmitters' power was cut out before the user reaches the short distance threshold? This system fails in these respects because it does not know the last state of the garage door if the transmission is terminated. Interference and interruption do occur in wireless communication, therefore storing the last state of the sensing object and allowing a wait period for certainty are very important.

U.S. Pat. No. 6,634,408 issued to Mays discloses a device which controls the closure of a garage door when a garage door controller located in a vehicle moves out of the range of a transmitter located in the occupant's garage. The effective outcome of this invention is similar to a delay time clock for the automatic closure of the garage door. A device such as time clock for automatic closure is not recommended for household use since there may be children and pets around during the automatic closing of the garage door when no adult is around to supervise.

Therefore, a need exists for a system which can be easily installed in a vehicle and house and which allows the status of one or more appliances to be monitored. If the status of the appliance requires that the household occupant take necessary action, the system will warn the occupant before he travels too far from his/her house. The function of the device shall be for reminding only and not for automatically controlling any of the appliances from a distance. The system would preferably remain operative even though other similar devices are operating in the same area. The system would preferably be a "smart" system that can operate independently of the type of sensor being used. The system would preferably be able to determine the last state of the monitored appliance even though the transmission of the signal is terminated. Also, the system shall comply with all local, state, and federal laws regarding the transmitting of radio frequency signals.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The invention provides a device for reminding a driver or other user of the undesirable status of an appliance, such as an automatic garage door that has been left open, a gas or electric stove that has been left on, or in instances where the status presents a danger or threat to household security and its occupants. The system generates an alarm such as an audible alarm and/or flashing light when the occupant has traveled a reasonable distance from a house being monitored. The system preferably does not generate an alarm when the occupant is close by the house such as when the occupant drives down to the mailbox or corner store with the intent of immediately returning, thereby obviating the annoyance of having to attend to a constant alarm signal.

The system is comprised of a remote unit and a base unit. The base unit is in direct communication with the appliances through sensors located at the property. The remote unit travels with the automobile and polls the base unit continuously. The base unit senses the condition of the appliance and puts out a wireless signal which contains data denoting the condition of the appliance being monitored. The remote unit receives this signal containing information from the base unit, stores it and analyzes it using a microprocessor if the signal transmission ceases within a defined time period. If the remote unit interprets the signal from the base unit as being undesirable, the remote unit sounds an alarm, warning the user. Likewise, if the remote unit interprets the signal from the base unit as being desirable, the remote unit remains in a receiving mode and no alarm is activated.

Accordingly, the following objects and advantages of the invention apply:

It is an object of this invention to provide an inventive device for warning a user of the undesirable condition of an appliance which can be used to monitor one, or a plurality of appliances.

It is another object of this invention to use a computing processor to analyze digital signals and process logic, and utilize electronic memory to store the last status of the appliances to provide a fail safe arrangement, should power at the base unit be cut off or if communication is cut off.

It is also an object of this invention to use the public radio frequency bands allowable by the federal laws for the radio transmitter and receiver of the system.

Still another object of the invention is to use intermittent signal, frequency hopping techniques and digital coded signals to allow multiple systems to operate in the same area without interference.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

The inventive device functions to warn a user of the undesirable condition of an appliance or other equipment (collectively "appliance" hereafter). The device can be designed to monitor any type of appliance by varying the type of sensor being used. An "undesirable condition" may be an automatic garage door that is left open, a toaster oven or electric heater that is left on, an air conditioner that is left on, a security alarm that is left de-activated, or any other condition which is deemed undesirable and would benefit from a warning device which allows a user to return to the location of the appliance and remedy its undesirable condition. The inventive device is comprised of a base unit system that is in monitoring contact with the appliance of interest through at least one sensor, and a remote receiving unit system which travels with the user, in an automobile. The base unit communicates status information regarding the appliance to the receiving unit by wireless means, and the receiving unit can determine whether the status of the appliance is undesirable and thereby warn the user of the undesirable appliance status.

Figure 1:
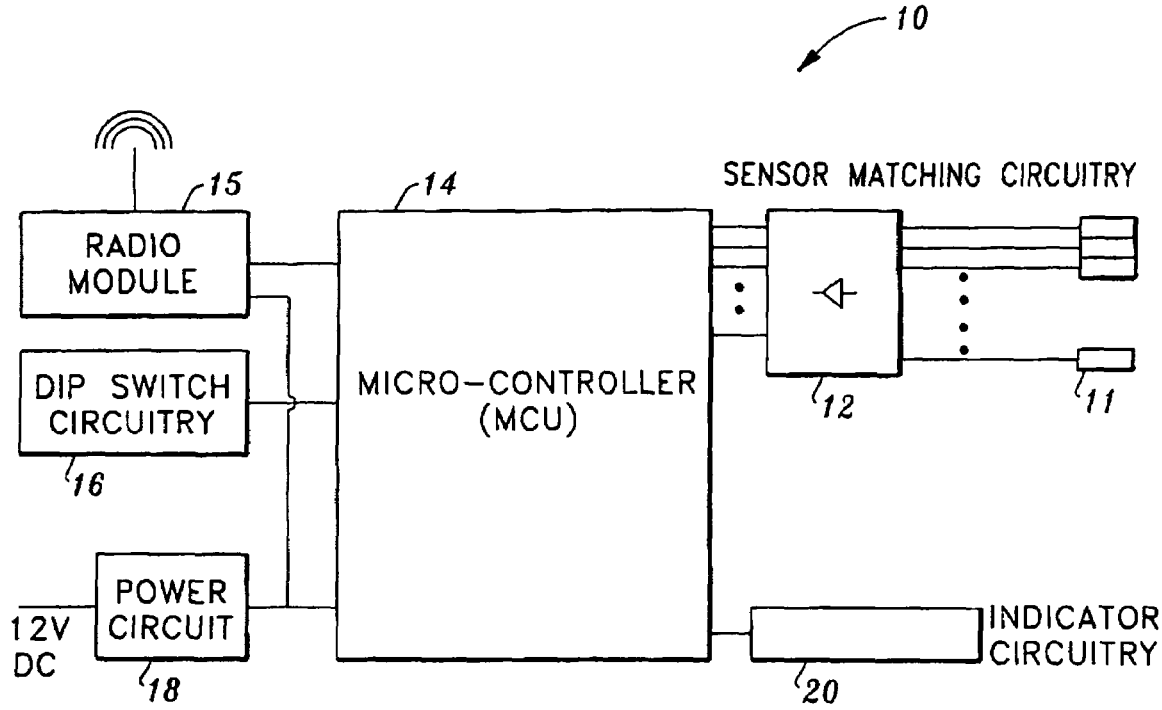
FIG. 1 is a block diagram of the circuitry which comprises the base unit of the invention.

Referring now to FIG. 1, the circuitry and function of the base unit can now be described. The base unit is most conveniently powered by current from the property upon which it is located. The base unit 10 comprises one or a plurality of sensors 11 which are in monitoring contact with one or a plurality of appliances. The sensors 11 could be of any type because of the flexibility of the sensor matching circuitry 12. In this regard, the sensor matching circuitry 12 includes impedance matching and electronic converter circuitry (not shown) adapted to the type of sensor that is employed. For example, a hall sensor could be used to measure if an electrical appliance has been left "on." A magnetic switch can be used as a sensor to determine if a garage door has been closed.

Still referring to FIG. 1, the sensor matching circuitry 12 comprises converters (not shown) for transforming the different types of sensors to the input values acceptable by the microcontroller unit (MCU) 14. For example, if the acceptable analog input value of the MCU 14 is 0 to 5 volts DC, then a hall sensor having an output of 0 to 2 volts DC will be converted to 0 to 5 volts DC. Another example would be a thermo sensor generating 4–20 milliamps current would be converted into a voltage output of 0 to 5 volts DC in order to match the acceptable values of the MCU 14. The MCU 14 has multiple input channels that make the base unit 10 capable of monitoring multiple sensors 11 by a single unit.

The MCU 14 compiles the appliance status information given by the sensor matching circuitry 12 into a specific digital format and then delivers the compiled information to the radio transceiver module 15. The radio transceiver module 15 receives sensor status information from the MCU and transmits the information from the MCU using a specific format and radio frequency. A non-limiting example of an MCU which suffices for purposes of the invention is the 8051 family of microcontrollers made by Chipcon AS, Inc., Intel, Phillips, Atmel or Dallas Semiconductor. The transmission would be accomplished using a digitally coded format preferably including frequency hopping techniques, as regulated by the FCC, to allow multiple systems to operate in the same area without interference. It is preferred that the radio frequency be in a range where a Federal Communication Commission (FCC) user license is not required, such as the 900 mhz band. This format and frequency is duplicated in the transceiver module of the remote unit. The DIP switch circuitry 16 operates as a peripheral circuitry for the MCU 14 to provide a means for setting a unique digital identification to the header of data communication and frequency channel for a pair of remote and base units. The power circuit 18 operates to regulate the power for the base unit 10 and protects sensitive components such as the radio module 15 and the MCU 14. The indicator circuitry 20 warns a user of the undesirable status of an appliance. The indicator circuitry 20 can comprise one or more LED indicators to visually warn an occupant of the status of one or more appliances prior to the occupant leaving the location where the base unit 10 is placed. If the occupant fails to notice the status of the monitored appliances, then the remote unit will provide a backup warning function.

Figure 2:
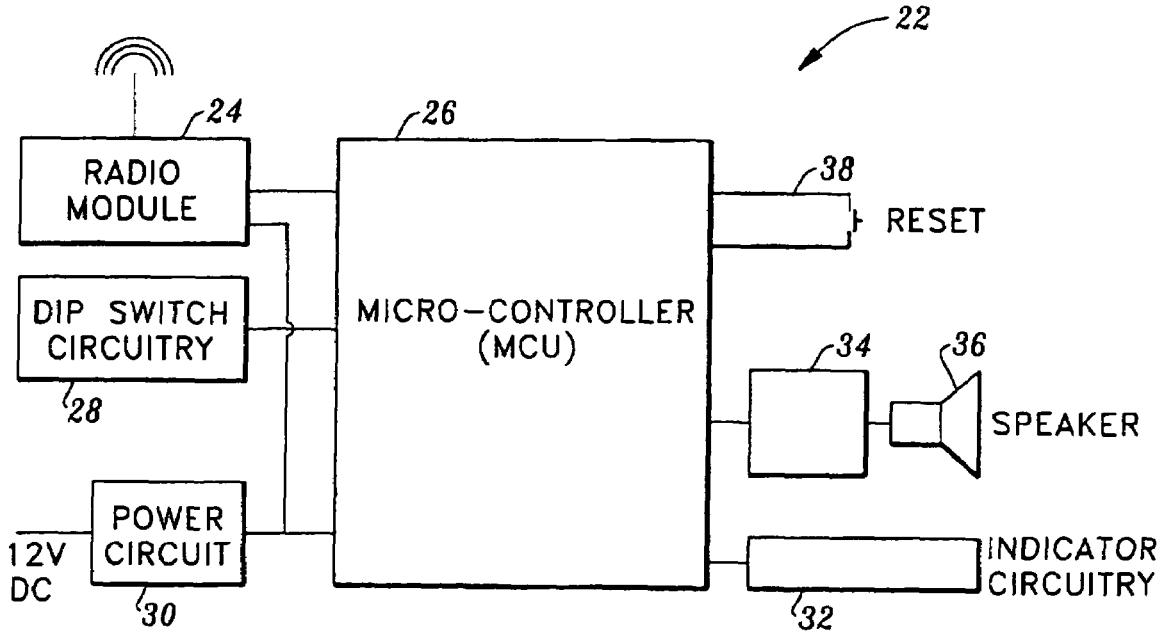
FIG. 2 is a block diagram of the circuitry which comprises the remote unit of the invention.

Referring now to FIG. 2, the remote unit 22 includes radio transceiver module 24, the module being capable of employing time slicing and frequency hopping techniques as was the base unit. The frequency of operation is also preferably the same as for the base unit, that is, in the unlicensed radio band. A non-limiting example of a radio transceiver module that would work well here is the Chipcon AS, Inc. cc1000 module or the Atmel AT86RF211 transceiver module. The transceiver module 24 receives the appliance status information from the base unit in a preferred digital format and passes the information to the MCU 26. The MCU 26 includes multi-channel inputs with built in memory, an IO unit, analog to digital/digital to analog function and processing unit. Suitable off the shelf MCU units for purposes of this invention include the PIC, 8051 family of microcontrollers made by Chipcon AS, Inc, Intel, Phillips, Atmel or Dallas Semiconductor.

The MCU 26 processes the digital information received from the transceiver module 24, stores this information to the internal memory and continues this process until a signal is no longer received from the base unit. When signal is no longer received, the MCU determines what action should be taken with regard to the appliance status information that was last received, according to the flow chart shown in FIG. 3, shown further herein.

Still referring to FIG. 2, the various other components of the remote unit 22 can be explained. The DIP switch circuitry 28 provides the same function as that described for the base unit 10. Since the remote unit 22 is powered by 12V DC current, the power circuit 30 modulates the incoming DC current for the use of the remote unit components. The remote unit can warn a user of the undesirable status of an appliance through either visual or audible means. The indicator circuitry 32 includes LED indicators to visually warn the user of an undesirable appliance status. The audio circuitry 34 and connected speaker 36 provide an audible warning, should the MCU determine that an undesirable status warning needs to be issued to the user. Upon receiving a warning, the user can shut off the audio or visual warning by activating the reset button 38 to cause the remote unit to switch back to its receiving mode.

Figure 3:
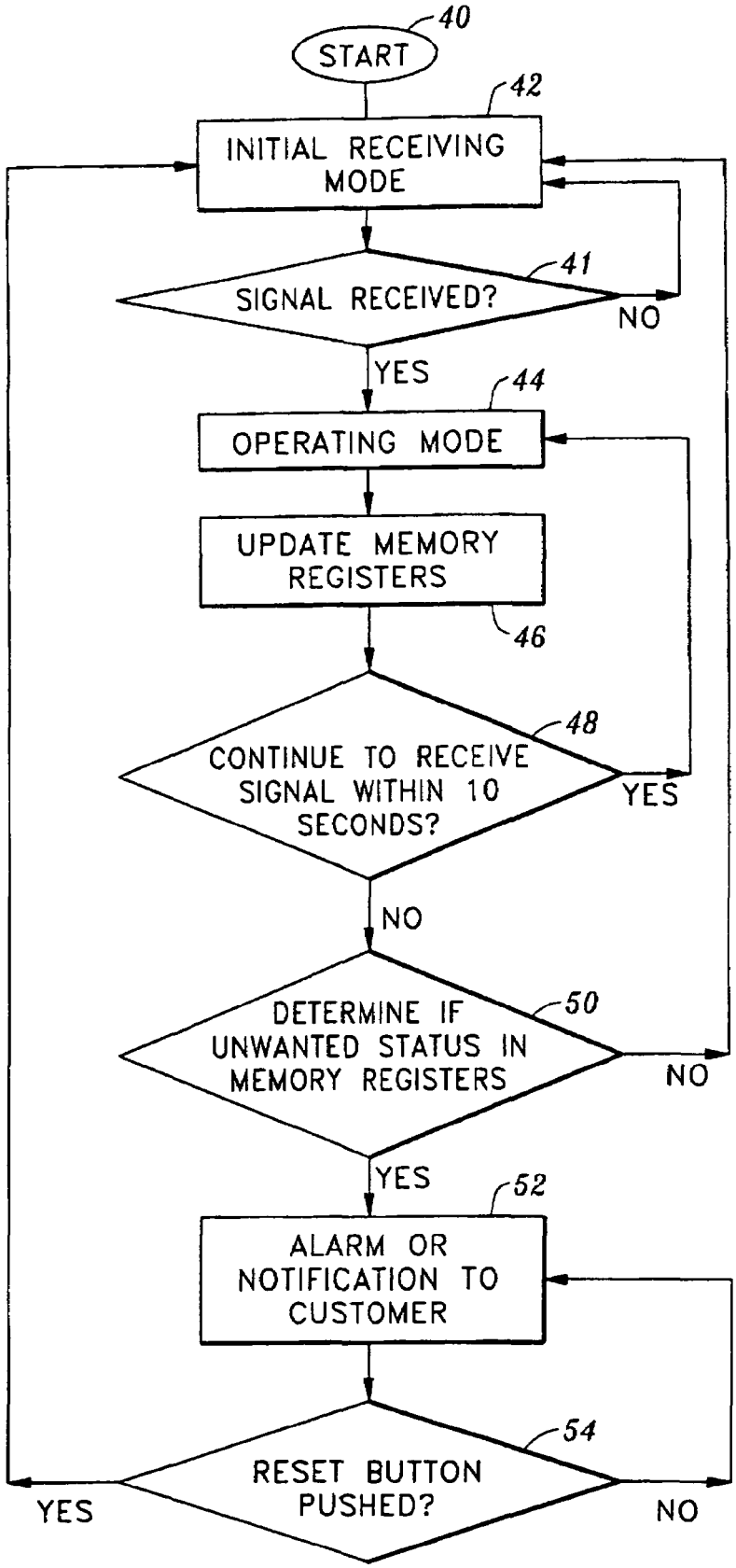
FIG. 3 is a flow diagram of the functioning processes of the MCU of the remote unit.

Referring to FIG. 3, the method of operation of the remote unit 22 portion of the invention is shown. The method shown in FIG. 3 is executed by software programmed into the MCU 26 of the remote unit. Upon start up 40, the remote unit 22 enters into its initial receiving mode 42 wherein all memory registers are automatically reset. If the remote unit 22 is not receiving a signal 41 from the base unit 10 in the matching band (e.g. 900 Mhz), then the remote unit remains in the initial receiving mode 42. If the base unit 10 is sending a signal, and the remote unit 22 receives the signal 41, the MCU recognizes the signal, and transfers the remote unit to operating mode 44. Once in operating mode 44, the MCU updates its memory registers 46 again so that the latest status information regarding a monitored appliance is input into the remote unit 22. The signal sent by the base unit is intermittent to lower the occupation of the frequency band by a single device, and comply with FCC regulations for frequency hopping. Because an intermittent signal is required to comply with FCC regulations, the status of the sensors has to be registered until a new status is received. In this regard, all signals should be digitally coded to permit a multi-user environment. In operating mode 44, the remote unit 22 will maintain and update the register by receiving signal from the base unit with matching digital code (matching base unit hereafter). If the matching base unit's signal is received, the remote unit 22 unit will reset the microcontroller's internal timer (not shown). If the internal timer exceeds a predetermined time period 48, then this indicates that either the remote unit has exceeded the cutoff distance for transmission of signal from the base unit 10 or the signal has been interrupted. Here, 10 seconds could be chosen as a time frame for checking for signal from the base unit. If no signal is received within the 10 second duration, the MCU 26 determines if the last update of the memory registers contained information on whether the status of the appliance was undesirable 50. If not, then the remote unit 22 does not signal any alarm 52 and returns to its initial receiving mode 42. However, if the last status of the appliance was determined to be undesirable 50, then the remote unit will sound an alarm 52 or activate a warning device (e.g. an LED indicator), thereby allowing the user the opportunity to return and remedy the status of the appliance to a desirable condition. If the alarm sounds, the user has the option of pressing the reset button 54 to return the remote unit to an initial receiving mode 42. If no signal is received by the remote unit 22 following reset, it remains in initial receiving mode 42 and does not advance to operating mode 44. It is necessary for the remote unit to receive signal from the base unit upon startup or reset in order for the remote unit to advance to the operating mode 44.

This device presents a passive solution to allow a user to remedy the undesirable status of an appliance. The device does not shut off, or act upon the appliance in any way, but instead allows the user the complete freedom to return and remedy the undesirable status, or not. Also, this device remains functional in the event that the power is cut to the base unit or if the signal is interrupted. If power is cut or the signal is interrupted this device stores the last remaining appliance status in the memory registers of the remote unit 22. If the last status was undesirable, the device will still warn the user to return and remedy the situation.

Finally, although the description above contains many specificities, these should not be construed as limiting the scope of the invention but as merely providing illustrations of some of the presently preferred embodiments of this invention. This invention may be altered and rearranged in numerous ways by one skilled in the art without departing from the coverage of any patent claims which are supported by this specification.

The invention claimed is:

1. A device for warning of the status of at least one sensor, comprising:

a sensing system in wireless communication with a receiving system;

said sensing system receiving status information from at least one sensor, said sensing system broadcasting said status information to said receiving system;

said receiving system further comprising a microcontroller and memory registers, said memory registers being regularly updated with said status information broadcast from said sensing system;

said memory registers being updated with said status information as long as said status information is being received within a defined time interval;

upon said receiving system determining that said time interval has been exceeded, said receiving system analyzing a last status information received from said sensing system;

said receiving system determining the desirability of said last status information; and if said last status information is deemed undesirable, said receiving system operating to actuate a warning device to warn a user of the undesirable state of said last status information.

2. The device as recited in claim 1, wherein said receiving system remains in an initial receiving mode until said receiving system receives a first status information broadcast from said sensing system.

3. The device as recited in claim 1, wherein said sensing system further comprises a warning device to warn a user of an undesirable status of said sensor.

4. A device for warning of the status of various appliances, comprising:

a sensing system in wireless communication with a receiving system; said sensing system including a microcontroller, said microcontroller including multiple sensor inputs for receiving multiple sensor status information from various appliances;

wireless broadcasting means for broadcasting said status information to said receiving system;

said receiving system further comprising a microcontroller and memory registers, said memory registers storing said received status information therein;

said memory registers being regularly updated with said status information broadcast from said wireless broadcasting means;

said memory registers being updated with said status information as long as said status information is being received within a defined time interval;

upon said receiving system determining that said time interval has been exceeded, said receiving system analyzing a last status information received from said sensing system;

said receiving system determining the desirability of said last status information; and if said last status information is deemed undesirable, said receiving system operating to actuate a warning device to warn a user of the undesirable state of said last status information.

* * * * *